US009196968B2

(12) United States Patent
Ko et al.

(10) Patent No.: US 9,196,968 B2
(45) Date of Patent: Nov. 24, 2015

(54) ANTENNA DEVICE

(71) Applicant: Cheng Uei Precision Industry Co., Ltd., New Taipei (TW)

(72) Inventors: Ching Hsiang Ko, New Taipei (TW); Kai Shih, New Taipei (TW); Jia Hung Su, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 246 days.

(21) Appl. No.: 13/923,318

(22) Filed: Jun. 20, 2013

(65) Prior Publication Data

US 2014/0375519 A1 Dec. 25, 2014

(51) Int. Cl.

| | |
|---|---|
| ***H01Q 21/00*** | (2006.01) |
| ***H01Q 19/30*** | (2006.01) |
| ***H01Q 1/24*** | (2006.01) |
| ***H01Q 21/28*** | (2006.01) |

(52) U.S. Cl.

CPC ..... *H01Q 19/30* (2013.01); *H01Q 1/243* (2013.01); *H01Q 21/28* (2013.01)

(58) Field of Classification Search

CPC ..... H01Q 19/30; H01Q 1/24; H01Q 1/241; H01Q 1/242; H01Q 1/243

USPC ..... 343/817–819

See application file for complete search history.

(56) References Cited

U.S. PATENT DOCUMENTS

| | | | | |
|---|---|---|---|---|
| 2007/0132591 | A1* | 6/2007 | Khatri | 340/572.7 |
| 2008/0159364 | A1* | 7/2008 | Rofougaran | 375/219 |
| 2009/0046014 | A1* | 2/2009 | Wu et al. | 343/700 MS |

* cited by examiner

*Primary Examiner* — Dameon E Levi
*Assistant Examiner* — Collin Dawkins
(74) *Attorney, Agent, or Firm* — Cheng-Ju Chiang

(57) ABSTRACT

An antenna device includes a first dielectric substrate made of a high dielectric coefficient material, a plurality of first contact pads fastened on a periphery of a top surface of the first dielectric substrate, a plurality of second dielectric substrates made of the high dielectric coefficient material, and a plurality of Yagi-Uda antennae respectively disposed on top surfaces of the second dielectric substrates. The second dielectric substrates are fastened on the first dielectric substrate. Each of the Yagi-Uda antennae has a drive, and a plurality of directors disposed in an outside position of the drive and spaced from an outer side of the drive. The directors are shorter than the drive, and the directors are arranged along a direction of being gradually away from the drive and gradually become shorter. An inner side of the drive defines a signal feed point.

10 Claims, 5 Drawing Sheets

ANTENNA DEVICE

BACKGROUND OF THE INVENTION

1. Field of the Invention

The present invention relates to an antenna device, and more particularly to an antenna device applied to a wireless communication product.

2. The Related Art

Nowadays, people are in an era of wireless communication technology being used everywhere, for example, talking on cell phones, information transmission and global positioning system navigation must rely on the wireless communication technology to be completed. As is known to all, in wireless communication system which is based on the wireless communication technology, an antenna device applied to a wireless communication product is often used as a carrier for receiving and sending electromagnetic wave signals. When the antenna device sends the electromagnetic wave signals, electric currents are converted into the electromagnetic wave signals. When the antenna device receives the electromagnetic wave signals, the electromagnetic wave signals are converted into the electric currents. Wireless communications include long distance wireless communications and short distance wireless communications. In the short distance high-frequency wireless communication, because a dimension of the antenna device is inversely proportional to a frequency of the electromagnetic wave signal, the dimension of the antenna device should be decreased for receiving and sending the high-frequency electromagnetic wave signals. In addition, in the short distance high-frequency wireless communication, the antenna device presents a high directivity characteristic in the process of receiving and sending the electromagnetic wave signals that makes radiation energies of the antenna device concentrated.

However, in spite of the dimension of the antenna device being decreased, receiving and sending frequencies of the antenna device are unable to reach a frequency band requirement of the high-frequency wireless communication. Moreover, in the short distance high-frequency wireless communication, the antenna device presents the high directivity characteristic in the process of receiving and sending the electromagnetic wave signals that makes the radiation energies of the antenna device concentrated. As a result, wireless communication angles of the antenna device are limited.

SUMMARY OF THE INVENTION

An object of the present invention is to provide an antenna device adapted for being applied to a wireless communication product for receiving and sending high-frequency electromagnetic wave signals. The antenna device includes a first dielectric substrate made of a high dielectric coefficient material, a plurality of first contact pads, a plurality of second dielectric substrates made of the high dielectric coefficient material, and a plurality of Yagi-Uda antennae. The first contact pads are fastened on a periphery of a top surface of the first dielectric substrate and spaced at regular intervals. The second dielectric substrates are fastened on the first dielectric substrate at regular intervals and located in inside positions of the first contact pads. The Yagi-Uda antennae are respectively disposed on top surfaces of the second dielectric substrates in different radiation directions to radiate outward. Each of the Yagi-Uda antennae has a drive for receiving and sending the high-frequency electromagnetic wave signals, and a plurality of directors disposed in an outside position of the drive and spaced from an outer side of the drive for pulling the high-frequency electromagnetic wave signals to radiate towards the director so as to improve a gain of the Yagi-Uda antenna. The directors are shorter than the drive, and the directors are arranged along a direction of being gradually away from the drive and gradually become shorter. An inner side of the drive away from the directors defines a signal feed point for feeding the high-frequency electromagnetic wave signals.

As described above, the Yagi-Uda antennae are respectively disposed on top surfaces of the second dielectric substrates, and the second dielectric substrates are fastened on the first dielectric substrate, so a dimension of the antenna device is decreased. In the circumstance of the dimension of the antenna device being decreased, the frequency of the high-frequency electromagnetic wave signal received and sent by the antenna device is able to reach the frequency band requirement of the high-frequency wireless communication. Furthermore, the Yagi-Uda antennae are respectively disposed on the top surfaces of the second dielectric substrates in the different radiation directions, so that the antenna device has multiple input and output characteristics for increasing wireless communication angles of the antenna device. As a result, a directivity problem of the antenna device is solved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
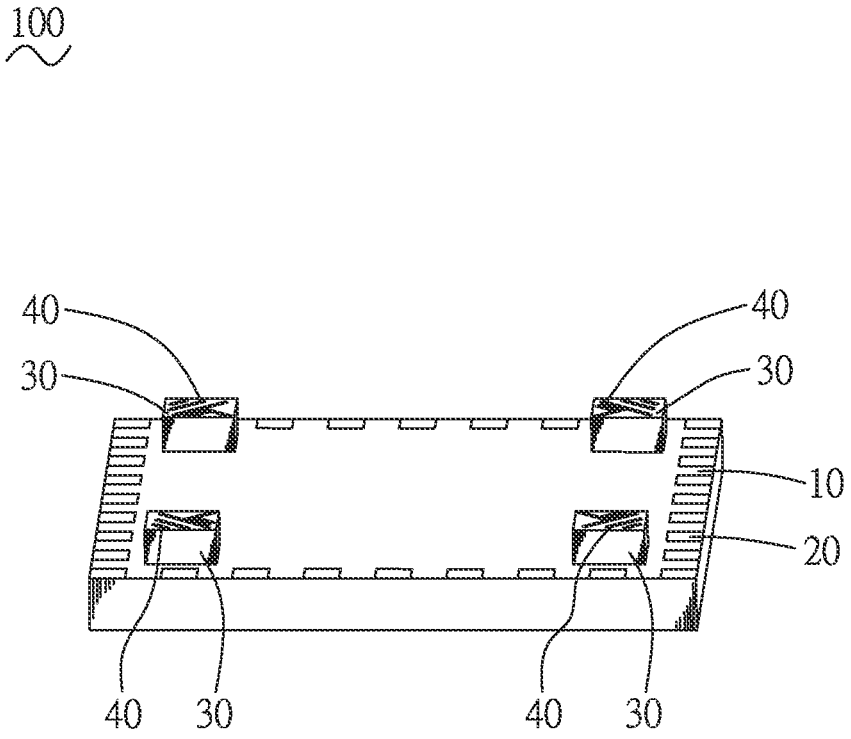
FIG. 1 is a perspective view of an antenna device in accordance with an embodiment of the present invention.
Figure 2:
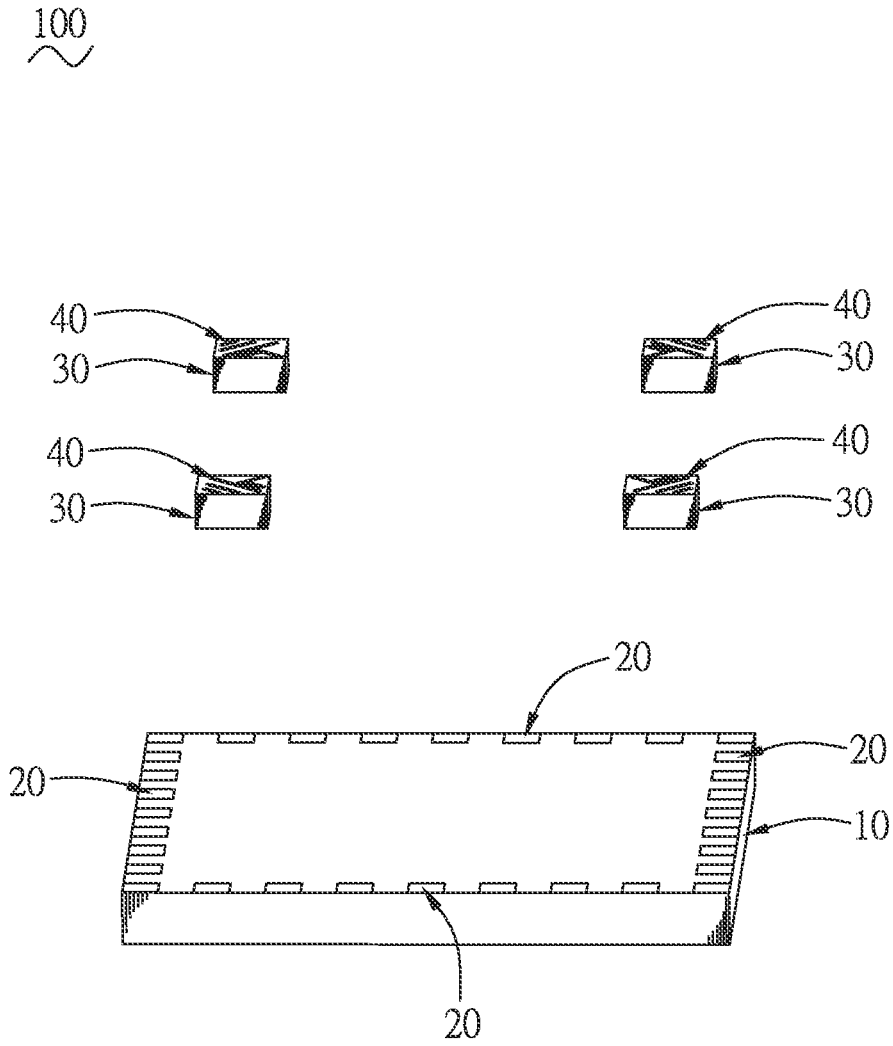
FIG. 2 is a partially exploded view of the antenna device of FIG. 1.
Figure 4:
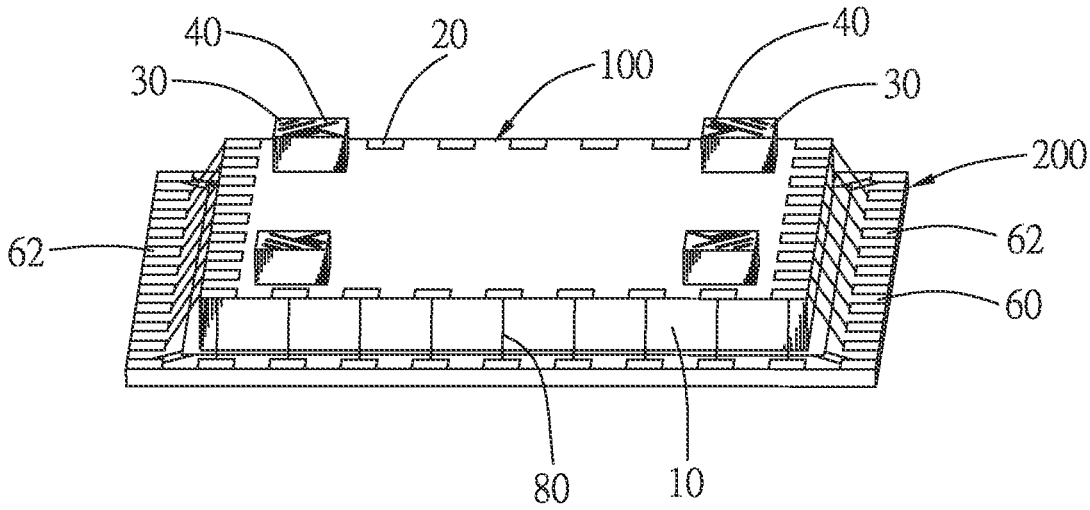
FIG. 4 is a perspective view of the antenna device of FIG. 1, which is applied to a wireless communication product.
Figure 5:
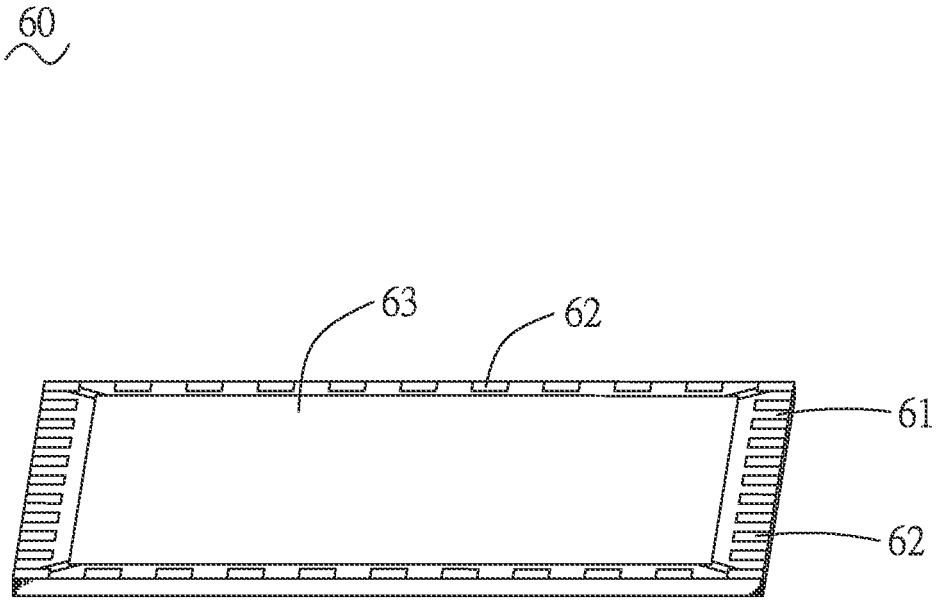
FIG. 5 is a perspective view of a circuit board of the wireless communication product of FIG. 4.

Referring to FIG. 1, FIG. 2 and FIG. 4, an antenna device 100 in accordance with an embodiment of the present invention is shown. The antenna device 100 is adapted for being applied to a wireless communication product 200 for receiving and sending high-frequency electromagnetic wave signals. The antenna device 100 in accordance with the embodiment of the present invention includes a first dielectric substrate 10, a plurality of first contact pads 20, a plurality of second dielectric substrates 30 and a plurality of Yagi-Uda antennae 40.

Referring to FIG. 1 and FIG. 2, the first dielectric substrate 10 is made of a high dielectric coefficient material. A communication circuit unit (not shown) which includes an amplifier is disposed in the first dielectric substrate 10. The high-frequency electromagnetic wave signals received and sent by the antenna device 100 should be amplified via the amplifier. The first contact pads 20 are fastened on a periphery of a top surface of the first dielectric substrate 10 and spaced at regular intervals.

Figure 3:
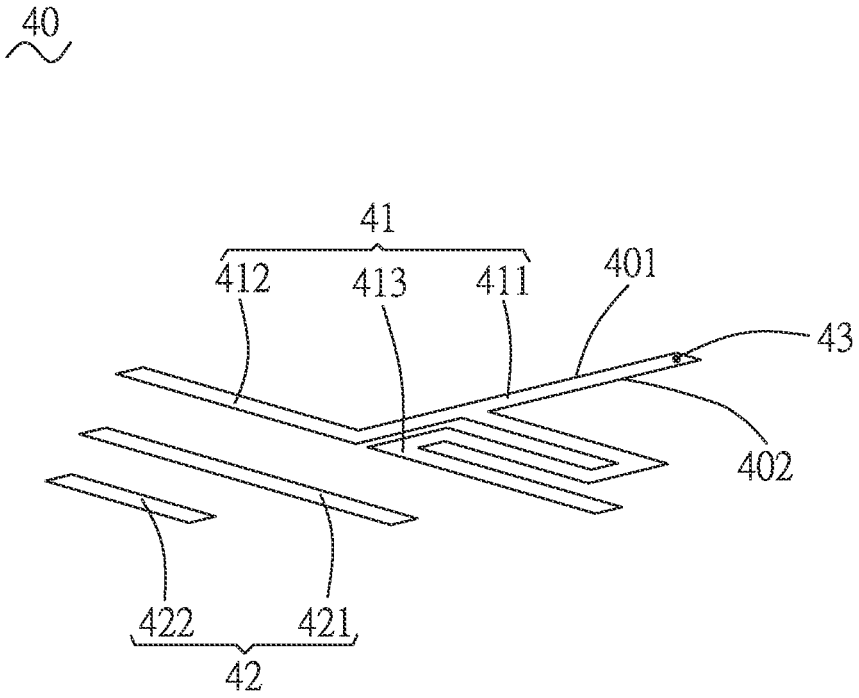
FIG. 3 is a perspective view of a Yagi-Uda antenna of the antenna device of FIG. 2.

Referring to FIG. 1, FIG. 2 and FIG. 3, the second dielectric substrate 30 is made of the high dielectric coefficient material. The Yagi-Uda antennae 40 are respectively disposed on top surfaces of the second dielectric substrates 30 in different radiation directions to radiate outward. The second dielectric substrates 30 are fastened on the first dielectric substrate 10 at regular intervals and located in inside positions of the first contact pads 20. Preferably, the second dielectric substrates 30 together with the Yagi-Uda antennae 40 disposed on the top surfaces of the second dielectric substrates 30 are centrosymmetrically fastened on the first dielectric substrate 10 and spaced at regular intervals. A spacing distance between each two adjacent second dielectric substrates 30 is one wavelength of the high-frequency electromagnetic wave signal received and sent by the antenna device 100. Accordingly, a spacing distance between each two Yagi-Uda antennae 40 disposed on the top surfaces of the second dielectric substrates 30 is one wavelength of the high-frequency electromagnetic wave signal received and sent by the antenna device 100.

Referring to FIG. 1, FIG. 2 and FIG. 3, the antenna device 100 includes N*N second dielectric substrates 30 and N*N Yagi-Uda antennae 40 respectively disposed on the top surfaces of the second dielectric substrates 30 in the different radiation directions to radiate outward, N is a natural number greater than 1, so that the antenna device 100 has multiple input and output characteristics for increasing wireless communication angles of the antenna device 100. In this embodiment, the antenna device 100 includes 2*2, namely four second dielectric substrates 30, and 2*2, namely four Yagi-Uda antennae 40 disposed on the top surfaces of the second dielectric substrates 30.

Referring to FIG. 1, FIG. 2 and FIG. 3, each of the Yagi-Uda antennae 40 has a drive 41 for receiving and sending the high-frequency electromagnetic wave signals, and a plurality of directors 42 disposed in an outside position of the drive 41 and spaced from an outer side of the drive 41 for pulling the high-frequency electromagnetic wave signals to radiate towards the director 42 so as to improve a gain of the Yagi-Uda antenna 40. The directors 42 are shorter than the drive 41. The directors 42 are arranged along a direction of being gradually away from the drive 41 and gradually become shorter. An inner side of the drive 41 away from the directors 42 defines a signal feed point 43 for feeding the high-frequency electromagnetic wave signals. The directors 42 include a first director 421 disposed away from the outer side of the drive 41 and shorter than the drive 41, and a second director 422 disposed away from an outer side of the first director 422 and shorter than the first director 421. A length of the drive 41 is half of the wavelength of the high-frequency electromagnetic wave signal received and sent by the antenna device 100. The drive 41 has an elongated base portion 411, and the base portion 411 has two opposite long edges which are respectively defined as a first edge 401 and a second edge 402. An outer side of the first edge 401 of the base portion 411 adjacent to the first director 421 extends horizontally and perpendicular to the base portion 411 to form a first extending portion 412. The second edge 402 of the base portion 411 extends opposite to the first extending portion 412 and then meanders towards the first director 421 and the second director 422 to form a second extending portion 413. The inner side of the base portion 411 away from the first director 421 and the second director 422 of the directors 42 defines the signal feed point 43.

Referring to FIG. 1 and FIG. 2, the Yagi-Uda antenna 40 is made of a metal material, and the Yagi-Uda antenna 40 is plated on the second dielectric substrate 30 which is made of the high dielectric coefficient material by virtue of a chemical vapor deposition technology of a semiconductor manufacturing technology, and the second dielectric substrates 30 together with the Yagi-Uda antennae 40 disposed on the top surfaces of the second dielectric substrates 30 are fastened on the first dielectric substrate 10 and spaced at regular intervals. The frequency of the high-frequency electromagnetic wave signal received and sent by the antenna device 100 are inversely proportional to a product of the wavelength of the high-frequency electromagnetic wave signal and the dielectric coefficient of the high permittivity material. So when the frequency of the high-frequency electromagnetic wave signal is definite, the dimension of the antenna device 100 is decreased.

Referring to FIG. 1, FIG. 2, FIG. 4 and FIG. 5, when the antenna device 100 is applied to the wireless communication product 200, the wireless communication product 200 includes a circuit board 60 and a plurality of bonding wires 80. The circuit board 60 includes an insulating board 61, a plurality of spaced second contact pads 62 disposed on a periphery of a top surface of the insulating board 61, and a ground area 63 disposed on a middle of the top surface of the insulating board 61. The first dielectric substrate 10 together with the second dielectric substrates 30 and the Yagi-Uda antennae 40 disposed on the top surfaces of the second dielectric substrates 30 is disposed on the ground area 63 of the circuit board 60. The first contact pads 20 disposed on the periphery of the top surface of the first dielectric substrate 10 is electrically connected with the second contact pads 62 disposed on the periphery of the top surface of the insulating board 61, so that the antenna device 100 is electrically connected with the circuit board 60. The wireless communication product 200 further includes a basic circuit unit (not shown) which has a plurality of conductive portions (not shown), the second contact pads 62 of the circuit board 60 is electrically connected with the conductive portions of the basic circuit unit so as to make the communication circuit unit disposed in the first dielectric substrate 10 electrically connect with the basic circuit unit by virtue of the circuit board 60.

Referring to FIG. 1 and FIG. 2, when the antenna device 100 is used in a short distance high-frequency wireless communication, the antenna device 100 receives and sends the high-frequency electromagnetic wave signal covering a frequency of 60 GHz corresponding to wireless gigabit alliance (WiGig) standard, and compatible with a frequency band ranged between 57 GHz and 66 GHz corresponding to institute of electrical and electronics engineers 802.11ad (IEEE 802.11ad) standard. The antenna device 100 feeds the high-frequency electromagnetic wave signals into the signal feed point 43 by a single-ended feed-in way. The high-frequency electromagnetic wave signals are amplified via the amplifier of the communication circuit unit disposed in the first dielectric substrate 10, the drive 41 receives the amplified high-frequency electromagnetic wave signals and then the drive 41 radiates the amplified high-frequency electromagnetic wave signals. So, in the circumstance of the dimension of the antenna device 100 being decreased, the frequency of the high-frequency electromagnetic wave signal received and sent by the antenna device 100 is able to reach a frequency band requirement of the high-frequency wireless communication.

As described above, the Yagi-Uda antennae 40 are respectively disposed on top surfaces of the second dielectric substrates 30, and the second dielectric substrates 30 together with the Yagi-Uda antennae 40 disposed on the top surfaces of the second dielectric substrates 30 are fastened on the first dielectric substrate 10, so the dimension of the antenna device 100 is decreased. In the circumstance of the dimension of the antenna device 100 being decreased, the frequency of the high-frequency electromagnetic wave signal received and sent by the antenna device 100 is able to reach the frequency band requirement of the high-frequency wireless communication. Furthermore, the Yagi-Uda antennae 40 are respectively disposed on the top surfaces of the second dielectric substrates 30 in the different radiation directions, so that the antenna device 100 has the multiple input and output characteristics for increasing wireless communication angles of the antenna device 100. As a result, a directivity problem of the antenna device 100 is solved.

What is claimed is:

1. An antenna device adapted for being applied to a wireless communication product for receiving and sending high-frequency electromagnetic wave signals, comprising:

a first dielectric substrate made of a high dielectric coefficient material;

a plurality of first contact pads fastened on a periphery of a top surface of the first dielectric substrate and spaced at regular intervals;

a plurality of second dielectric substrates made of the high dielectric coefficient material, the plurality of second dielectric substrates being fastened on the first dielectric substrate at regular intervals and located in inside positions of the plurality of first contact pads; and a plurality of Yagi-Uda antennae respectively disposed on top surfaces of the plurality of second dielectric substrates in different radiation directions to radiate outward, each of the plurality of Yagi-Uda antennae having a drive for receiving and sending the high-frequency electromagnetic wave signals, and a plurality of directors disposed in an outside position of the drive and spaced from an outer side of the drive for pulling the high-frequency electromagnetic wave signals to radiate towards the director so as to improve a gain of the Yagi-Uda antenna, the plurality of directors being shorter than the drive, and the plurality of directors being arranged along a direction of being gradually away from the drive and gradually becoming shorter, an inner side of the drive away from the plurality of directors defining a signal feed point for feeding the high-frequency electromagnetic wave signals;

wherein the plurality of directors include a first director disposed away from the outer side of the drive and shorter than the drive, and a second director disposed away from an outer side of the first director and shorter than the first director;

wherein the drive has an elongated base portion, and the base portion has two opposite long edges which are respectively defined as a first edge and a second edge, an outer side of the first edge of the base portion, adjacent to the first director extends horizontally and perpendicular to the base portion to form a first extending portion, the second edge of the base portion extends opposite to the first extending portion and then meanders towards the first director and the second director to form a second extending portion, the inner side of the base portion away from the first director and the second director of the plurality of directors defines the signal feed point.

2. The antenna device as claimed in claim 1, wherein the plurality of second dielectric substrates together with the plurality of Yagi-Uda antennae disposed on the top surfaces of the plurality of second dielectric substrates are centrosymmetrically fastened on the first dielectric substrate and spaced at regular intervals.

3. The antenna device as claimed in claim 1, wherein a spacing distance between each two adjacent second dielectric substrates is one wavelength of the high-frequency electromagnetic wave signal received and sent by the antenna device.

4. The antenna device as claimed in claim 1, wherein the antenna device includes N*N second dielectric substrates and N*N Yagi-Uda antennae respectively disposed on the top surfaces of the plurality of second dielectric substrates in the different radiation directions to radiate outward, N is a natural number greater than 1.

5. The antenna device as claimed in claim 4, wherein the antenna device includes 2*2, namely four second dielectric substrates, and 2*2, namely four Yagi-Uda antennae disposed on the top surfaces of the plurality of second dielectric substrates.

6. The antenna device as claimed in claim 1, wherein a length of the drive is half of the wavelength of the high-frequency electromagnetic wave signal received and sent by the antenna device.

7. The antenna device as claimed in claim 1, wherein the Yagi-Uda antenna is made of a metal material, and the Yagi-Uda antenna is plated on the second dielectric substrate which is made of the high dielectric coefficient material by virtue of a chemical vapor deposition technology of a semiconductor manufacturing technology.

8. The antenna device as claimed in claim 1, wherein the antenna device is applied to the wireless communication product which includes a circuit board and a plurality of bonding wires, the circuit board includes an insulating board, a plurality of spaced second contact pads disposed on a periphery of a top surface of the insulating board, and a ground area disposed on a middle of the top surface of the insulating board, the first dielectric substrate together with the plurality of second dielectric substrates and the plurality of Yagi-Uda antennae disposed on the top surfaces of the plurality of second dielectric substrates is disposed on the ground area of the circuit board, the plurality of first contact pads disposed on the periphery of the top surface of the first dielectric substrate is electrically connected with the plurality of spaced second contact pads disposed on the periphery of the top surface of the insulating board, so that the antenna device is electrically connected with the circuit board.

9. The antenna device as claimed in claim 1, wherein the antenna device receives and sends the high-frequency electromagnetic wave signal covering a frequency of 60 GHz corresponding to wireless gigabit alliance standard, and compatible with a frequency band ranged between 57 GHz and 66 GHz corresponding to institute of electrical and electronics engineers 802.11ad standard.

10. An antenna device adapted for being applied to a wireless communication product for receiving and sending high-frequency electromagnetic wave signals, comprising:

a first dielectric substrate made of a high dielectric coefficient material;

a plurality of first contact pads fastened on a periphery of a top surface of the first dielectric substrate and spaced at regular intervals;

a plurality of second dielectric substrates made of the high dielectric coefficient material, the plurality of second dielectric substrates being fastened on the first dielectric substrate at regular intervals and located in inside positions of the plurality of first contact pads; and a plurality of Yagi-Uda antennae respectively disposed on top surfaces of the plurality of second dielectric substrates in different radiation directions to radiate outward, each of the plurality of Yagi-Uda antennae having a drive for receiving and sending the high-frequency electromagnetic wave signals, and a plurality of directors disposed in an outside position of the drive and spaced from an outer side of the drive for pulling the high-frequency electromagnetic wave signals to radiate towards the director so as to improve a gain of the Yagi-Uda antenna, the plurality of directors being shorter than the drive, and the plurality of directors being arranged along a direction of being gradually away from the drive and gradually becoming shorter, an inner side of the drive away from the plurality of directors defining a signal feed point for feeding the high-frequency electromagnetic wave signals;

wherein the antenna device is applied to the wireless communication product which includes a circuit board and a plurality of bonding wires, the circuit board includes an insulating board, a plurality of spaced second contact pads disposed on a periphery of a top surface of the insulating board, and a ground area disposed on a middle of the top surface of the insulating board, the first dielectric substrate together with the plurality of second dielectric substrates and the plurality of Yagi-Uda antennae disposed on the top surfaces of the plurality of second dielectric substrates is disposed on the ground area of the circuit board, the plurality of first contact pads disposed on the periphery of the top surface of the first dielectric substrate is electrically connected with the plurality of spaced second contact pads disposed on the periphery of the top surface of the insulating board, so that the antenna device is electrically connected with the circuit board.

* * * * *